US011668301B2

(12) United States Patent
Bonnefoi et al.

(10) Patent No.: US 11,668,301 B2
(45) Date of Patent: Jun. 6, 2023

(54) SCROLL COMPRESSOR HAVING A PRESS-FITTED MOTOR AND A VERTICALLY CENTRAL SUCTION INLET

(71) Applicant: Danfoss Commercial Compressors, Trevoux (FR)

(72) Inventors: Patrice Bonnefoi, Saint Didier au Mont D'or (FR); Yann Even, Nordborg (DK); Yves Rosson, Villars les Dombes (FR); Brian Angel, Nordborg (DK); Meldener Gael, Lyons (FR)

(73) Assignee: Danfoss Commercial Compressors, Trevoux (FR)

( * ) Notice: Subject to any disclaimer, the term of this patent is extended or adjusted under 35 U.S.C. 154(b) by 185 days.

(21) Appl. No.: 17/087,986

(22) Filed: Nov. 3, 2020

(65) Prior Publication Data

US 2021/0131432 A1 May 6, 2021

(30) Foreign Application Priority Data

Nov. 6, 2019 (FR) ..... 19/12452

(51) Int. Cl.
*F04C 18/02* (2006.01)
*F04C 15/06* (2006.01)
*F04C 23/00* (2006.01)

(52) U.S. Cl.
CPC ..... *F04C 18/0215* (2013.01); *F04C 15/06* (2013.01); *F04C 2240/10* (2013.01);
(Continued)

(58) Field of Classification Search
CPC ..... F04C 15/06; F04C 18/0215; F04C 23/008
See application file for complete search history.

(56) References Cited

U.S. PATENT DOCUMENTS 5,873,710 A 2/1999 Tucker
7,896,629 B2 3/2011 Ignatiev et al.
(Continued)

FOREIGN PATENT DOCUMENTS

CN 1191266 A 8/1998
CN 1754044 A 3/2006
(Continued)

OTHER PUBLICATIONS

English translation of KR2018011951 by PE2E, Jun. 8, 2022.*
(Continued)

*Primary Examiner* — Deming Wan
(74) *Attorney, Agent, or Firm* — McCormick, Paulding & Huber PLLC

(57) ABSTRACT

The scroll compressor (2) includes a hermetic casing (3) comprising a mid shell (4) provided with a suction inlet (7); a compression unit (11) arranged within the hermetic casing (3); a drive shaft (27) configured to drive an orbiting scroll (13) of the compression unit (11); an electric motor (21) coupled to the drive shaft (27) and configured to drive in rotation the drive shaft (27) about its rotational axis, the electric motor (21) including a rotor (22) and a stator (23) which includes a stator stack (24), wherein the stator stack (24) is press-fitted in the mid shell (4), the suction inlet (7) is facing the stator stack (24), and the compression unit (11) includes a single suction opening (34) arranged at an opposite position in relation to the suction inlet (7).

19 Claims, 2 Drawing Sheets

(52) U.S. Cl.
CPC ..... *F04C 2240/30* (2013.01); *F04C 2240/40* (2013.01); *F04C 2240/50* (2013.01); *F04C 2240/60* (2013.01)

(56) References Cited

U.S. PATENT DOCUMENTS

| | | | | |
|---|---|---|---|---|
| 2004/0057837 | A1 | 3/2004 | Skinner | |
| 2004/0170509 | A1 | 9/2004 | Wehrenberg et al. | |
| 2015/0152864 | A1 | 6/2015 | Nagaoka et al. | |
| 2017/0089624 | A1 | 3/2017 | Yokoyama et al. | |
| 2017/0260980 | A1* | 9/2017 | Stephens | F04C 29/0085 |

FOREIGN PATENT DOCUMENTS

| | | | | | |
|---|---|---|---|---|---|
| CN | 101223364 | A | | 7/2008 | |
| CN | 107925313 | A | | 4/2018 | |
| EP | 1 672 768 | A2 | | 6/2006 | |
| JP | H07158569 | A | * | 6/1995 | F04C 18/02 |
| KR | 100342467 | B1 | | 11/2002 | |
| KR | 20180119051 | A | * | 11/2018 | F04C 18/0215 |

OTHER PUBLICATIONS

English translation of JP H07158569 by PE2E Dec. 17, 2022.*
First Examination Report for Indian Patent Application No. 202014046621 dated Jul. 2, 2021.
Search Report for French Patent Application No. 1912452 dated May 20, 2020.

* cited by examiner

[Fig. 1]
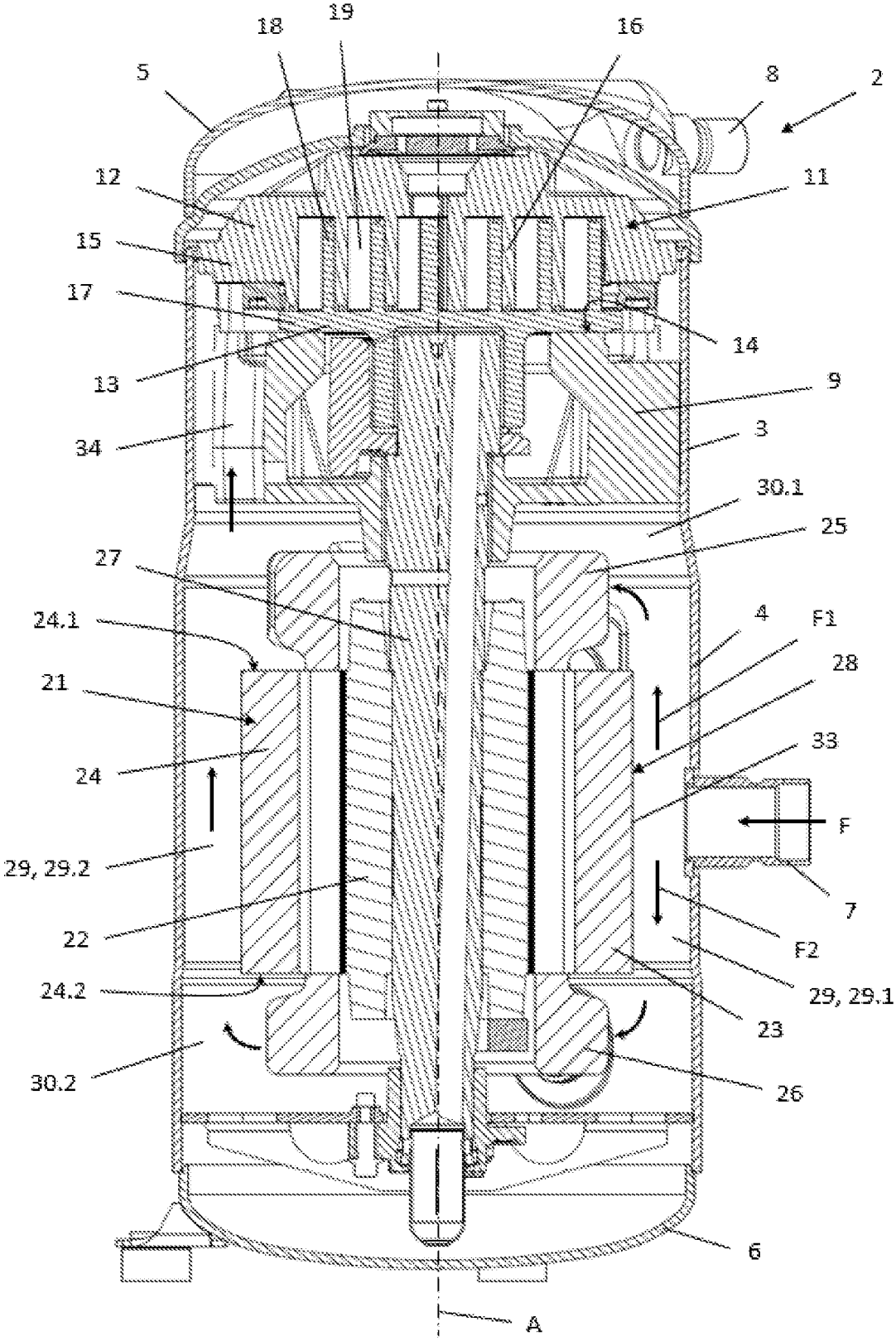

[Fig. 2]
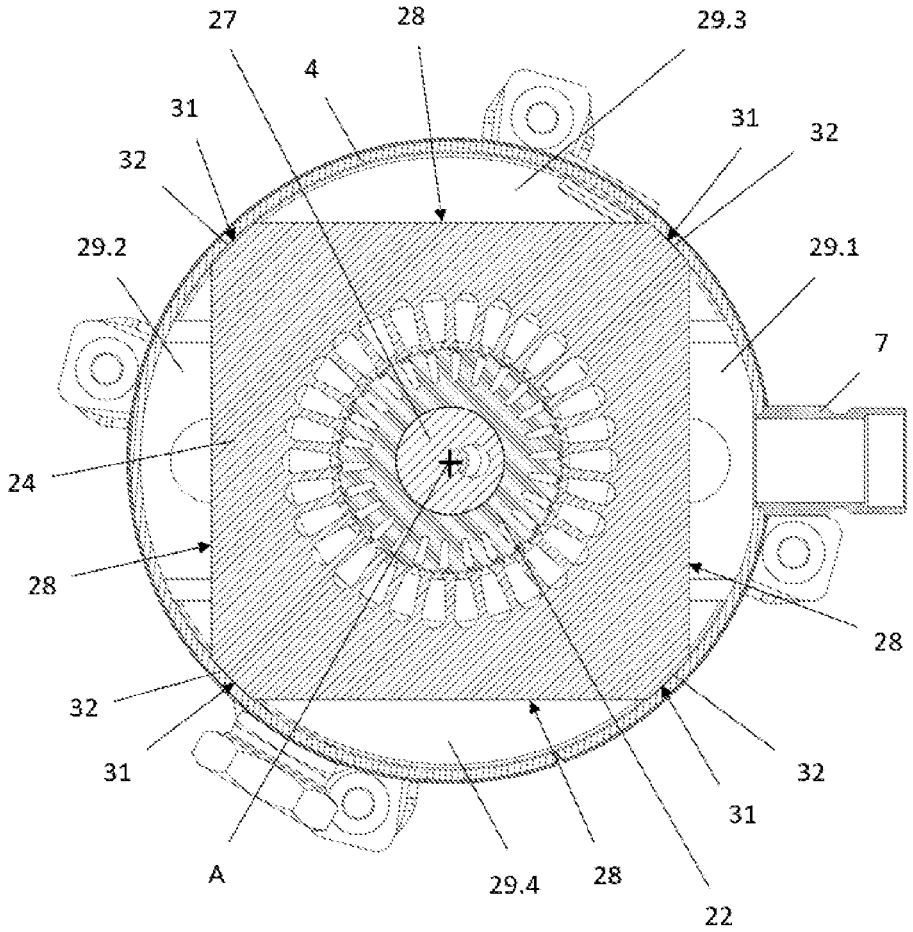

SCROLL COMPRESSOR HAVING A PRESS-FITTED MOTOR AND A VERTICALLY CENTRAL SUCTION INLET

CROSS-REFERENCE TO RELATED APPLICATION

This application claims foreign priority benefits under 35 U.S.C. § 119 to French Patent Application No. 19/12452 filed on Nov. 6, 2019, the content of which is hereby incorporated by reference in its entirety.

TECHNICAL FIELD

The present invention relates to a scroll compressor, and in particular to a scroll refrigeration compressor.

BACKGROUND

As known, a scroll compressor includes:

a hermetic casing comprising a mid shell provided with a suction inlet configured to supply the scroll compressor with refrigerant to be compressed, a compression unit arranged within the hermetic casing and configured to compress the refrigerant supplied by the suction inlet, a drive shaft configured to drive an orbiting scroll of the compression unit in an orbital movement, the drive shaft being rotatable around a rotation axis, an electric motor coupled to the drive shaft and configured to drive in rotation the drive shaft about the rotational axis, the electric motor including a rotor and a stator which is disposed around the rotor.

The electric motor of such a scroll compressor is generally arranged within an inner shell which is secured to a support frame on which is slidably mounted an orbiting scroll of the compression unit. Such a mounting of the electric motor complicates the assembly of the scroll compressor and thus increases the manufacturing cost of the scroll compressor.

In addition, in order to ensure an effective cooling of the electric motor, and particularly of first and second stator end windings of a stator of the electric motor, the presence of the inner shell requires the provisions of specific flow passages on the inner shell and/or an support elements supporting a lower end of the drive shaft, which further increases the manufacturing cost of the scroll compressor.

SUMMARY

It is an object of the present invention to provide an improved scroll compressor which can overcome the drawbacks encountered in conventional scroll compressors.

Another object of the present invention is to provide a scroll compressor which ensures an effective cooling of the electric motor, while substantially reducing the manufacturing cost of the scroll compressor.

According to the invention such a scroll compressor includes:

a hermetic casing comprising a mid shell provided with a suction inlet configured to supply the scroll compressor with refrigerant to be compressed, a compression unit arranged within the hermetic casing and configured to compress the refrigerant supplied by the suction inlet, a drive shaft configured to drive an orbiting scroll of the compression unit in an orbital movement, the drive shaft being rotatable around a rotation axis, an electric motor coupled to the drive shaft and configured to drive in rotation the drive shaft about the rotational axis, the electric motor including a rotor and a stator which is disposed around the rotor and which includes a stator stack, wherein the stator stack is press-fitted in the mid shell, the suction inlet is at least partially facing the stator stack, and the compression unit includes a suction opening arranged at an opposite position in relation to the suction inlet.

By press-fitting the stator stack of the electric motor directly in the mid shell, the securing of the electric motor does not require additional securing parts, which simplifies the assembly of the scroll compressor and reduces the manufacturing cost of the scroll compressor.

In addition, the specific locations of the suction inlet and the suction opening ensures that at least a first part of a refrigerant flow, entering the scroll compressor through the suction inlet, flows along the stator stack towards a first stator end winding of the stator and through said first stator end winding before reaching the suction opening of the compression unit, and at least of second part of the refrigerant flow flows along the stator stack towards a second stator end winding of the stator and through said second stator end winding before reaching the suction opening of the compression unit. Therefore, such a configuration of the scroll compressor ensures an effective cooling of the electric motor and particularly of the stator end windings, and thus an improved efficiency of the electric motor.

Furthermore, such an arrangement of the stator stack, of the suction inlet and of the suction opening defines simpler gas flow passages, which limits the pressure drop within the scroll compressor and thus improves the efficiency of the scroll compressor.

Moreover, such an arrangement of the stator stack, of the suction inlet and of the suction opening avoids passage of liquid towards the compression unit, and thus improves the compressor reliability.

The scroll compressor may also include one or more of the following features, taken alone or in combination.

According to an embodiment of invention, the suction inlet has a central axis which crosses the stator stack.

According to an embodiment of invention, the stator stack is shrink-fitted in the mid shell.

According to an embodiment of invention, the suction opening is axially shifted with respect to the suction inlet and is opposite to the suction inlet with respect to the rotation axis of the drive shaft.

According to an embodiment of the invention, the suction opening is configured to supply the compression unit with refrigerant which has been previously supplied to the scroll compressor through the suction inlet.

According to an embodiment of invention, the suction inlet is facing a central portion of the stator stack. According to an embodiment of invention, the central portion of the stator stack is substantially longitudinally centered along a longitudinal length of the stator stack.

According to an embodiment of the invention, the central portion of the stator stack is longitudinally centered between a first axial end face of the stator stack and a second axial end face of the stator stack.

According to an embodiment of invention, the suction inlet extends radially with respect to the rotation axis of the drive shaft.

According to an embodiment of invention, the stator stack includes a plurality of lateral surfaces which are substantially flat and which are angularly shifted with respect to the rotation axis of the drive shaft, the suction inlet facing a respective lateral surface of the plurality of lateral surfaces.

According to an embodiment of the invention, the plurality of lateral surfaces includes four lateral surfaces.

According to an embodiment of invention, the suction inlet is equidistant from first and second longitudinal edges of the respective lateral surface of the stator stack.

According to an embodiment of the invention, the respective lateral surface extends substantially parallel to the rotation axis of the drive shaft.

According to an embodiment of invention, the stator stack and the mid shell define a plurality of longitudinal gas flow passages which are angularly shifted with respect to the rotation axis of the drive shaft, the plurality of longitudinal gas flow passages including a first longitudinal gas flow passage into which emerges the suction inlet and a second longitudinal gas flow passage which is substantially opposite to the first longitudinal gas flow passage with respect to the rotation axis of the drive shaft.

According to an embodiment of invention, a ratio of a cross-sectional area of the first longitudinal gas flow passage on a cross-sectional area of the suction inlet is higher than or equal to 1.5.

According to an embodiment of the invention, a ratio of a cross-sectional area of each of the plurality of longitudinal gas flow passages on the cross-sectional area of the suction inlet is higher than or equal to 1.5.

According to an embodiment of invention, each lateral surface of the stator stack partially defines a respective longitudinal gas flow passage of the plurality of longitudinal gas flow passages.

According to an embodiment of invention, the stator stack includes a plurality of longitudinal contact surfaces which are angularly shifted with respect to the rotation axis of the drive shaft and which are bearing against an inner surface of the mid shell at respective longitudinal contact areas.

According to an embodiment of invention, each longitudinal gas flow passage of the plurality of longitudinal gas flow passages is laterally delimited by two adjacent longitudinal contact areas.

According to an embodiment of invention, the stator stack, the mid shell and the suction inlet are configured such that a refrigerant flow entering the scroll compressor, and for example entering the first longitudinal gas flow passage, through the suction inlet is divided into a first flow flowing towards a first stator end winding of the stator and a second flow flowing towards a second stator end winding of the stator.

According to an embodiment of invention, the first flow is configured to flow at least partially through the first stator end winding before reaching the suction opening of the compression unit, and the second flow is configured to flow at least partially through the second stator end winding before reaching the suction opening of the compression unit.

According to an embodiment of the invention, the first flow is configured to flow through the first longitudinal gas flow passage and at least partially through the first stator end winding before reaching the suction opening of the compression unit, and the second flow is configured to flow through the first longitudinal gas flow passage, at least partially through the second stator end winding and at least partially through the second longitudinal gas flow passage before reaching the suction opening of the compression unit.

According to an embodiment of the invention, the first stator end winding is closer to the compression unit than the second stator end winding.

According to an embodiment of the invention, the scroll compressor includes a first chamber containing the first stator end winding and a second chamber containing the second stator end winding, each longitudinal gas flow passage fluidly connecting the first chamber to the second chamber. Particularly, each longitudinal gas flow passage includes a first passage end emerging into the first chamber and a second passage end emerging into the second chamber.

According to an embodiment of invention, the orbiting scroll is supported by and in slidable contact with a support frame arranged within the hermetic casing, the suction opening being provided on the support frame.

According to an embodiment of invention, the stator stack has a cross section having a substantially square shape.

According to an embodiment of invention, the compression unit includes a fixed scroll having a fixed end plate and a fixed spiral wrap extending from the fixed end plate, and the orbiting scroll has an orbiting end plate and an orbiting spiral wrap extending from the orbiting end plate, the fixed spiral wrap and the orbiting spiral wrap meshing with each other to form compression chambers.

According to an embodiment of invention, the drive shaft is a vertical drive shaft. Advantageously, the suction inlet is located substantially at a same height than the central portion of the stator stack.

According to an embodiment of invention, the suction opening is configured to supply the compression unit with at least 80%, advantageously with 90%, of the refrigerant supplied to the scroll compressor through the suction inlet.

According to an embodiment of invention, the suction opening is configured to supply the compression unit with substantially all the refrigerant supplied to the scroll compressor through the suction inlet.

According to an embodiment of invention, the suction opening is a single suction opening.

These and other advantages will become apparent upon reading the following description in view of the drawing attached hereto representing, as non-limiting example, one embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

FIG. 1 is a longitudinal section view of a scroll compressor according to the invention.

FIG. 2 is a cross-section view of the scroll compressor of FIG. 1.

DETAILED DESCRIPTION

FIG. 1 shows a scroll compressor 2 occupying a vertical position. However, the scroll compressor 2 according to the invention could occupy an inclined position, or a horizontal position, without significant modification to its structure.

The scroll compressor 2 comprises a hermetic casing 3 including a mid shell 4, an upper cap 5 and a lower cap 6. The mid shell 4 is substantially cylindrical and may have an outer diameter which is constant over the entire length of the mid shell 4 or which is variable along the length of the mid shell 4.

The scroll compressor 2 further comprises a suction inlet 7 configured to supply the scroll compressor 2 with refrigerant to be compressed, and a discharge outlet 8 configured to discharge compressed refrigerant. Advantageously, the suction inlet 7 is provided on the mid shell 4, and the discharge outlet 8 is provided on the upper cap 5.

The scroll compressor 2 also comprises a support frame 9 arranged within the hermetic casing 3 and secured to the mid shell 4, and a compression unit 11 also arranged within the hermetic casing 3 and disposed above the support frame 9. The compression unit 11 is configured to compress the refrigerant supplied by the suction inlet 7, and includes a fixed scroll 12 and an orbiting scroll 13 interfitting with each other. In particular, the orbiting scroll 13 is supported by and in slidable contact with a thrust bearing surface 14 provided on the support frame 9, and the fixed scroll 12 is fixed in relation to the hermetic casing 3.

The fixed scroll 13 has a fixed end plate 15, a fixed spiral wrap 16 projecting from the fixed end plate 15 towards the orbiting scroll 13. The orbiting scroll 13 has an orbiting end plate 17 and an orbiting spiral wrap 18 projecting from the orbiting end plate 17 towards the fixed scroll 12. The orbiting spiral wrap 18 of the orbiting scroll 13 meshes with the fixed spiral wrap 16 of the fixed scroll 12 to form a plurality of compression chambers 19 between them. The compression chambers 19 have a variable volume which decreases from the outside towards the inside, when the orbiting scroll 13 is driven to orbit relative to the fixed scroll 12.

The scroll compressor 2 further comprises an electric motor 21 disposed below the support frame 9. The electric motor 21 has a rotor 22, and a stator 23 disposed around the rotor 22.

The stator 23 includes a stator stack 24, also named stator core, which is press-fitted in the mid shell 4. According to the embodiment shown on the figures, the stator stack 24 has a cross section having a substantially square shape.

The stator 23 also include a stator windings wound on the stator stack 24. The stator windings define a first stator end winding 25 which is formed by the portions of the stator windings extending outwardly from a first axial end face 24.1 of the stator stack 24, and a second stator end winding 26 which is formed by the portions of the stator windings extending outwardly from a second axial end face 24.2 of the stator stack 24. The first stator end winding 25 is closer to the compression unit 11 than the second stator end winding 26.

Furthermore, the scroll compressor 2 comprises a drive shaft 27 which is vertical and rotatable around a rotation axis A. The drive shaft 27 is coupled to the rotor 22 of the electrical motor 21 such that the electric motor 21 is configured to drive in rotation the drive shaft 27 about the rotational axis A. The drive shaft 27 is particularly configured to drive the orbiting scroll 13 in an orbital movement when the electric motor 21 is operated.

According to the embodiment shown on the figures, the stator stack 24 includes a plurality of lateral surfaces 28, for example four lateral surfaces, which are substantially flat and which are angularly shifted with respect to the rotation axis A of the drive shaft 27. Advantageously, each of the lateral surfaces 28 extends parallel to the rotation axis A of the drive shaft 27.

The stator stack 24 and the mid shell 4 define a plurality of longitudinal gas flow passages 29 which are angularly shifted with respect to the rotation axis A of the drive shaft 27. The plurality of longitudinal gas flow passages 29 includes a first longitudinal gas flow passage 29.1 into which emerges the suction inlet 7 and a second longitudinal gas flow passage 29.2 which is opposite to the first longitudinal gas flow passage 29.1 with respect to the rotation axis A of the drive shaft 27. Advantageously, the plurality of longitudinal gas flow passages 29 also includes two additional longitudinal gas flow passages 29.3, 29.4 which are opposite to each other with respect to the rotation axis A of the drive shaft 27 and which are each angularly located between the first and second longitudinal gas flow passages 29.1, 29.2.

Particularly, each lateral surface 28 of the stator stack 24 partially defines a respective longitudinal gas flow passage 29 of the plurality of longitudinal gas flow passages.

According to an embodiment of invention, a ratio of a cross-sectional area of each of the longitudinal gas flow passages 29 on a cross-sectional area of the suction inlet 7 is higher than or equal to 1.5.

The scroll compressor 2 includes a first chamber 30.1 containing the first stator end winding 25 and a second chamber 30.2 containing the second stator end winding 26. Each longitudinal gas flow passage 29 fluidly connects the first chamber 30.1 to the second chamber 30.2, and particularly includes a first passage end emerging into the first chamber 30.1 and a second passage end emerging into the second chamber 30.2.

The stator stack 24 particularly includes a plurality of longitudinal contact surfaces 31 which are angularly shifted with respect to the rotation axis A of the drive shaft 27 and which are bearing against an inner surface of the mid shell 4 at respective longitudinal contact areas 32. Advantageously, each longitudinal gas flow passage 29 of the plurality of longitudinal gas flow passages is laterally delimited by two adjacent longitudinal contact areas 32.

As shown on FIGS. 1 and 2, the suction inlet 7 extends radially with respect to the rotation axis A of the drive shaft 27 and is facing a central portion 33 of a respective lateral surface 28 of the stator stack 24. Said central portion 33 is longitudinally centered along a longitudinal length of the stator stack 24, and thus is longitudinally centered between the first and second axial end faces 24.1, 24.2 of the stator stack 24. Thus, the suction inlet 7 is located substantially at a same height than the central portion 33 of the stator stack 24. Advantageously, the suction inlet 7 is equidistant from first and second longitudinal edges of the respective lateral surface 28 of the stator stack 24, and thus from the respective longitudinal contact areas 32.

As shown on FIG. 1, the compression unit 11 includes a single suction opening 34 which is provided on the support frame 9 and which is arranged at an opposite position in relation to the suction inlet 7. Particularly, the suction opening 34 is axially shifted with respect to the suction inlet 7 and is opposite to the suction inlet 7 with respect to the rotation axis A of the drive shaft 27. The suction opening 34 is configured to supply the compression unit 11 with refrigerant which has been previously supplied to the scroll compressor 2 through the suction inlet 7.

The stator stack 24, the mid shell 4 and the suction inlet 7 are configured such that a refrigerant flow F entering the scroll compressor 2, and particularly entering the first longitudinal gas flow passage 29.1, through the suction inlet 7 is divided into a first flow F1 flowing towards the first stator end winding 25 and the second flow F2 flowing towards the second stator end winding 26.

Advantageously, the first flow F1 is configured to flow through the first longitudinal gas flow passage 29.1 towards the first chamber 30.1 and at least partially through the first stator end winding 25 before reaching the suction opening 34 of the compression unit 11, and the second flow F2 is configured to flow through the first longitudinal gas flow passage 29.1 towards the second chamber 30.2, at least partially through the second stator end winding 26 and then, from the second chamber 30.2, through the second longitudinal gas flow passage 29.2 and the two additional longitudinal gas flow passages 29.3, 29.4 towards the first chamber 30.1 before reaching the suction opening 34 of the compression unit 11.

Such a configuration of the scroll compressor 2 according to the present invention ensures an improved cooling of the first stator end winding 25 and of the second stator end winding 26 by the refrigerant entering the scroll compressor 2 through the suction inlet 7 before said refrigerant reaches the compression unit 11 via the suction opening 34, and thus an improved efficiency of the electric motor.

Further, by press-fitting the stator stack 24 of the electric motor 21 directly in the mid shell 4, the securing of the electric motor 21 does not require additional securing parts, which simplifies the assembly of the scroll compressor 2 and reduces the manufacturing cost of the scroll compressor 2.

Of course, the invention is not restricted to the embodiment described above by way of non-limiting example, but on the contrary it encompasses all embodiments thereof.

What is claimed is:

1. A scroll compressor including:

a hermetic casing comprising a mid shell provided with a suction inlet configured to supply the scroll compressor with refrigerant to be compressed, a compression unit arranged within the hermetic casing and configured to compress the refrigerant supplied by the suction inlet, a drive shaft configured to drive an orbiting scroll of the compression unit in an orbital movement, the drive shaft being rotatable around a rotation axis, an electric motor coupled to the drive shaft and configured to drive in rotation the drive shaft about the rotational axis, the electric motor including a rotor and a stator which is disposed around the rotor and which includes a stator stack, wherein the stator stack is press-fitted in the mid shell, the suction inlet is at least partially facing the stator stack, and the compression unit includes a single suction opening arranged at an opposite position in relation to the suction inlet with respect to the rotational axis.

2. The scroll compressor according to claim 1, wherein the suction inlet extends radially with respect to the rotation axis of the drive shaft.

3. The scroll compressor according to claim 2, wherein the stator stack includes a plurality of lateral surfaces which are substantially flat and which are angularly shifted with respect to the rotation axis of the drive shaft, the suction inlet facing a respective lateral surface of the plurality of lateral surfaces.

4. The scroll compressor according to claim 2, wherein the stator stack and the mid shell define a plurality of longitudinal gas flow passages which are angularly shifted with respect to the rotation axis of the drive shaft, the plurality of longitudinal gas flow passages including a first longitudinal gas flow passage into which emerges the suction inlet and a second longitudinal gas flow passage which is substantially opposite to the first longitudinal gas flow passage with respect to the rotation axis of the drive shaft.

5. The scroll compressor according to claim 1, wherein the stator stack includes a plurality of lateral surfaces which are substantially flat and which are angularly shifted with respect to the rotation axis of the drive shaft, the suction inlet facing a respective lateral surface of the plurality of lateral surfaces.

6. The scroll compressor according to claim 5, wherein the suction inlet is equidistant from first and second longitudinal edges of the respective lateral surface of the stator stack.

7. The scroll compressor according to claim 6, wherein the stator stack and the mid shell define a plurality of longitudinal gas flow passages which are angularly shifted with respect to the rotation axis of the drive shaft, the plurality of longitudinal gas flow passages including a first longitudinal gas flow passage into which emerges the suction inlet and a second longitudinal gas flow passage which is substantially opposite to the first longitudinal gas flow passage with respect to the rotation axis of the drive shaft.

8. The scroll compressor according to claim 5, wherein the stator stack and the mid shell define a plurality of longitudinal gas flow passages which are angularly shifted with respect to the rotation axis of the drive shaft, the plurality of longitudinal gas flow passages including a first longitudinal gas flow passage into which emerges the suction inlet and a second longitudinal gas flow passage which is substantially opposite to the first longitudinal gas flow passage with respect to the rotation axis of the drive shaft.

9. The scroll compressor according to claim 1, wherein the stator stack and the mid shell define a plurality of longitudinal gas flow passages which are angularly shifted with respect to the rotation axis of the drive shaft, the plurality of longitudinal gas flow passages including a first longitudinal gas flow passage into which emerges the suction inlet and a second longitudinal gas flow passage which is substantially opposite to the first longitudinal gas flow passage with respect to the rotation axis of the drive shaft.

10. The scroll compressor according to claim 9, wherein a ratio of a cross-sectional area of the first longitudinal gas flow passage on a cross-sectional area of the suction inlet is higher than or equal to 1,5.

11. The scroll compressor according to claim 9, wherein each longitudinal gas flow passage of the plurality of longitudinal gas flow passages is laterally delimited by two adjacent longitudinal contact areas.

12. The scroll compressor according to claim 1, wherein the stator stack includes a plurality of longitudinal contact surfaces which are angularly shifted with respect to the rotation axis of the drive shaft and which are bearing against an inner surface of the mid shell at respective longitudinal contact areas.

13. The scroll compressor according to claim 1, wherein the stator stack, the mid shell and the suction inlet are configured such that a refrigerant flow entering the scroll compressor through the suction inlet is divided into a first flow flowing towards a first stator end winding of the stator and a second flow flowing towards a second stator end winding of the stator.

14. The scroll compressor according to claim 13, wherein the first flow is configured to flow at least partially through the first stator end winding before reaching the suction opening of the compression unit, and the second flow is configured to flow at least partially through the second stator end winding before reaching the suction opening of the compression unit.

15. The scroll compressor according to claim 1, wherein the orbiting scroll is supported by and in slidable contact with a support frame arranged within the hermetic casing, the suction opening being provided on the support frame.

16. The scroll compressor according to claim 1, wherein the stator stack has a cross section having a substantially square shape.

17. The scroll compressor according to claim 1, wherein the suction inlet is facing a central portion of the stator stack.

18. The scroll compressor according to claim 17, wherein the central portion of the stator stack is substantially longitudinally centered along a longitudinal length of the stator stack.

19. The scroll compressor according to claim 1, wherein the suction opening is configured to supply the compression unit with at least 80% of the refrigerant supplied to the scroll compressor through the suction inlet.

* * * * *